US009437915B2

(12) United States Patent
Potratz

(10) Patent No.: US 9,437,915 B2
(45) Date of Patent: Sep. 6, 2016

(54) LINE BRIDGING ELEMENT FOR TWO MICROSTRIP LINES AND METHOD

(71) Applicant: Carsten Potratz, Gerlingen (DE)

(72) Inventor: Carsten Potratz, Gerlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 11 days.

(21) Appl. No.: 14/468,492

(22) Filed: Aug. 26, 2014

(65) Prior Publication Data

US 2015/0054602 A1 Feb. 26, 2015

(30) Foreign Application Priority Data

Aug. 26, 2013 (DE) ..... 10 2013 216 929

(51) Int. Cl.

| | |
|---|---|
| ***H01P 5/02*** | (2006.01) |
| ***H01P 7/10*** | (2006.01) |
| ***H01P 3/08*** | (2006.01) |
| ***H01P 11/00*** | (2006.01) |

(52) U.S. Cl.

CPC ..... *H01P 7/10* (2013.01); *H01P 3/081* (2013.01); *H01P 5/028* (2013.01); *H01P 11/008* (2013.01); *Y10T 29/49016* (2015.01)

(58) Field of Classification Search

CPC ..... H01P 5/028; H01P 3/08; H01P 3/081; H01P 7/10

USPC ..... 333/24 R, 204, 219.1, 235

See application file for complete search history.

(56) References Cited

U.S. PATENT DOCUMENTS

| | | | | |
|---|---|---|---|---|
| 6,111,485 | A * | 8/2000 | Carlsson | H01P 1/20309 333/235 |
| 6,958,667 | B2 * | 10/2005 | Mizoguchi | H01P 7/084 333/204 |
| 7,310,030 | B2 * | 12/2007 | Tsai | H01P 1/20381 333/204 |
| 7,394,334 | B2 * | 7/2008 | Okano | H01P 7/082 333/134 |
| 2012/0117797 | A1 * | 5/2012 | Stone | H01L 24/75 29/832 |
| 2013/0021118 | A1 | 1/2013 | Yeates | |

* cited by examiner

*Primary Examiner* — Dean Takaoka
(74) *Attorney, Agent, or Firm* — Norton Rose Fulbright US LLP

(57) ABSTRACT

A line bridging element for two microstrip lines, each of which are configured to conduct electromagnetic waves having a wavelength in the millimeter wavelength range, including a dielectric resonator, including a first coupling point, which is configured to couple the line-conducted electromagnetic wave, which is carried in the first microstrip line, into the dielectric resonator, including a second coupling point, which is configured to decouple the electromagnetic wave coupled into the dielectric resonator into the first microstrip line. The invention also provides a method for manufacturing a line bridging element.

12 Claims, 3 Drawing Sheets

LINE BRIDGING ELEMENT FOR TWO MICROSTRIP LINES AND METHOD

RELATED APPLICATION INFORMATION

The present application claims priority to and the benefit of German patent application no. 10 2013 216 929.9, which was filed in Germany on Aug. 26, 2013, the disclosure of which is incorporated herein by reference.

FIELD OF THE INVENTION

The present invention relates to a line bridging element for two microstrip lines, each of which is configured to conduct electromagnetic waves having a wavelength in the millimeter wavelength range. The present invention also relates to a method for manufacturing a line bridging element according to the present invention.

BACKGROUND INFORMATION

In modern electronic applications, the clock frequencies in particular of digital circuits and the frequencies of analog signals are becoming increasingly higher.

The wavelengths of the processed signals in such cases may reach into the millimeter range and below.

The guidance and distribution of high-frequency signals with wavelengths in the millimeter range normally occur in industrial applications using a conventional printed circuit board technology, in which specific high frequency substrate materials are used which permit a frequency of approximately 100 GHz using adapted microstrip lines.

Patent document US 2013/021118 discusses an exemplary microstrip line.

Such specific high-frequency substrate materials are very expensive, however, and difficult to process. For this reason, generally only one individual layer or one individual coating in the printed circuit board made of this high-frequency substrate material is situated on one side of the printed circuit board stack for distributing the high-frequency signals.

However, the limitation to one individual layer of the printed circuit board stack or one individual signal level for distributing the high-frequency signals restricts the design freedom when designing and routing the high-frequency signal network, since it is not possible to cross different signal lines on one individual layer.

SUMMARY OF THE INVENTION

The present invention provides a line bridging element having the features described herein and a method having the features described herein.

Accordingly, provided is:

A line bridging element for two microstrip lines, each of which is configured for conducting electromagnetic waves having a wavelength in the millimeter wavelength range, including a dielectric resonator, which has a first coupling point configured to couple the line-conducted electromagnetic wave carried in the first microstrip line into the dielectric resonator, and a second coupling point configured to decouple the electromagnetic wave coupled into the dielectric resonator into the first microstrip line.

Also provided is:

A method for manufacturing a line bridging element for two microstrip lines according to the present invention, each of which is configured for conducting electromagnetic waves having a wavelength in the millimeter wavelength range, including the steps of arranging a first coupling point in the first microstrip line, which couples the line-conducted electromagnetic wave carried in the first microstrip line into a dielectric resonator, arranging a second coupling point in the first microstrip line opposite the first coupling point, the second coupling point decoupling the electromagnetic wave coupled into the dielectric resonator into the first microstrip line, and arranging the dielectric resonator on top of the first coupling point and the second coupling point.

The present invention is based on the finding that the use of an individual layer in a printed circuit board stack for distributing the high-frequency signals severely limits the design freedom of the developer.

The idea underlying the present invention is to take this finding into account and to provide an option for permitting a crossing of high-frequency signal lines on such a layer of a printed circuit board stack.

For this purpose, the present invention provides a line bridging element for a microstrip line, which makes it possible for a first microstrip line to be bridged by a second microstrip line.

For this purpose, the first microstrip line includes two coupling points on top of which a dielectric resonator is situated.

In this configuration, the first coupling point serves to couple the electromagnetic wave carried in the first microstrip line into the dielectric resonator.

The second coupling point serves to decouple the electromagnetic wave, which was coupled into the dielectric resonator, from the dielectric resonator into the first microstrip line.

In this configuration, the functions of the first and the second coupling points may be carried out from one of the two coupling points, depending on the direction of the signal.

The present invention makes it possible to cross signal lines which carry signals having a wavelength in the millimeter wavelength range, without having to provide an additional high-frequency coating or an additional high-frequency layer on the printed circuit board.

In particular, two microstrip lines are crossed with the aid of the present invention in such a way that the signals on the two microstrip lines are only very slightly distorted.

Advantageous specific embodiments and refinements result from the subclaims and from the description with reference to the figures.

In one specific embodiment, the first microstrip line is interrupted between the coupling points. In addition, the second microstrip runs under the dielectric resonator between the two coupling points.

In one specific embodiment, the dielectric resonator is formed from a plastic. This permits a very simple and cost-efficient manufacture of the dielectric resonator.

In one specific embodiment, the dimensions of the dielectric resonator are calculated and established based on the electric resonator mode used and the permittivity of the material used for the dielectric resonator. This makes it possible to adapt the dielectric resonator to different frequency ranges and to use it in different applications.

In one specific embodiment, the dielectric resonator is coated at least partially with metal. This makes it possible to limit the required resonator volume and to limit the emission of the signal coupled into the dielectric resonator into the free space.

In one specific embodiment, the dielectric resonator includes solder pads, which may be soldered onto a printed circuit board, and which are configured to fix the dielectric resonator on the printed circuit board.

In one specific embodiment, the solder pads are electrically coupled to the metal. This makes it possible to couple the metal with which the dielectric resonator is coated to the high-frequency ground of the printed circuit board.

In one specific embodiment, the dielectric resonator has a rectangular shape or a cube shape or a cylindrical shape. This makes it possible to adapt the dielectric resonator to different applications and environmental conditions.

In one specific embodiment, the first coupling point and/or the second coupling point widen in the direction of the resonator from the width of the first microstrip line up to a predefined width, in particular to the width of the dielectric resonator. By widening the microstrip line toward the dielectric resonator, an abrupt impedance jump is avoided, and the coupling to the dielectric resonator is improved, which results in a minimal insertion attenuation and improves the bandwidth of the line bridging element.

The aforementioned embodiments and refinements may, if meaningful, be arbitrarily combined with one another. Additional potential embodiments, refinements and implementations of the present invention also include combinations not explicitly cited of features of the present invention described previously or below in conjunction with the exemplary embodiments. In particular, those skilled in the art will also add individual aspects as improvements or additions to the respective base form of the present invention.

The present invention is explained in greater detail below with reference to the exemplary embodiments specified in the schematic figures of the drawings.

DETAILED DESCRIPTION

Figure 1:
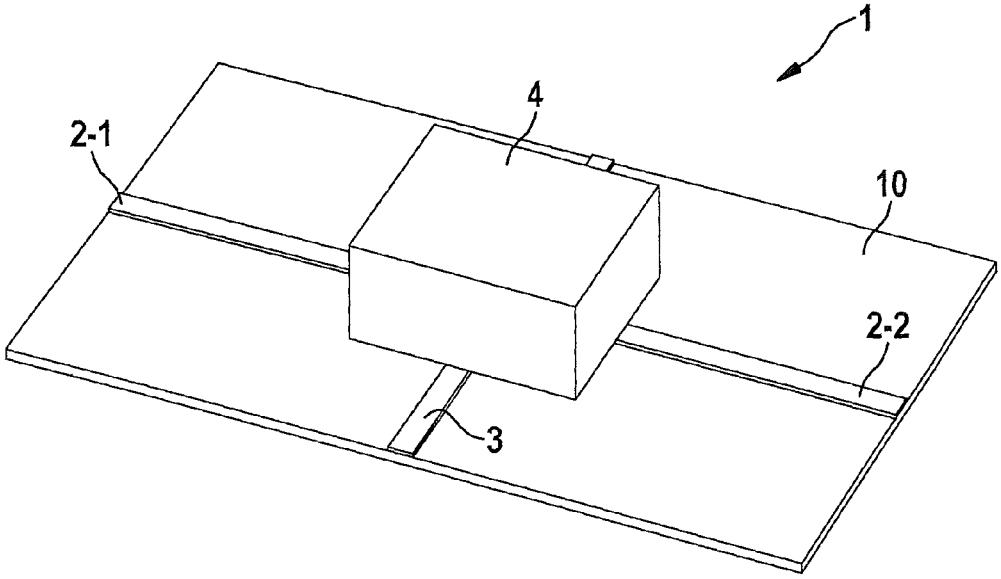
FIG. 1 shows a representation of one specific embodiment of a line bridging element according to the present invention.

In all of the figures, the same or functionally similar elements and devices are—unless otherwise specified—provided with the same reference numerals.

A microstrip line is understood within the scope of this patent application to mean a line on a printed circuit board, which is suitable to carry a signal which has a wavelength in the millimeter wavelength range. In particular, the microstrip lines are configured to carry the signals with what may be little attenuation.

A dielectric resonator is understood within the scope of the present invention to mean a component which is made of a dielectric material, and in which a resonance mode may be induced by the coupled signal.

The coupling points of the present patent application are areas of the first microstrip line, which are arranged at or under the dielectric resonator, and which may couple the signal into the dielectric resonator. For this purpose, the coupling points are configured, in particular, from the same material as the first microstrip line.

A partial coating with metal is understood within the scope of the present invention to mean that at least one side or one surface of the dielectric resonator is coated. In particular, the dielectric resonator is coated in such a way that it emits no electromagnetic waves.

A widening of the coupling points is understood to mean that they become wider, for example, in the shape of a funnel. Other geometric variants of the widening are also possible.

The term printed circuit board is understood within the scope of the present invention to mean not only a printed circuit board having one single coating or one single layer. Rather, a printed circuit board within the scope of the present invention may also be a multi-layered printed circuit board. A printed circuit board represented in the figures or a printed circuit board cited in the figures may in various specific embodiments also be configured as merely one coating or one layer of a printed circuit board stack.

FIG. 1 shows a representation of one specific embodiment of a line bridging element 1 according to the present invention.

Line bridging element 1 includes one first microstrip line 2-1, 2-2, which extends transversely across a printed circuit board 10. Line bridging element 1 also includes one second microstrip line 3, which runs at a 90° angle to first microstrip line 2-1, 2-2, also transversely across printed circuit board 10. A dielectric resonator 4 is situated on the printed circuit board on top of the point of intersection of first microstrip line 2-1, 2-2 and second microstrip line 3. The intersection of two microstrip lines 2-1, 2-2 and 3 is not visible in FIG. 1, since these are hidden by dielectric resonator 4. However, first microstrip line 2-1, 2-2 is interrupted under dielectric resonator 4 so that second microstrip line 3 is able to run uninterrupted under dielectric resonator 4. Consequently, first microstrip line 2-1, 2-2 includes a first section 2-1 and a second section 2-2, which are coupled to one another by dielectric resonator 4. First coupling point 5 and second coupling point 6 are not separately indicated in FIG. 1, since they lie under the ends of dielectric resonator 4 and are hidden by the latter.

Figure 3:
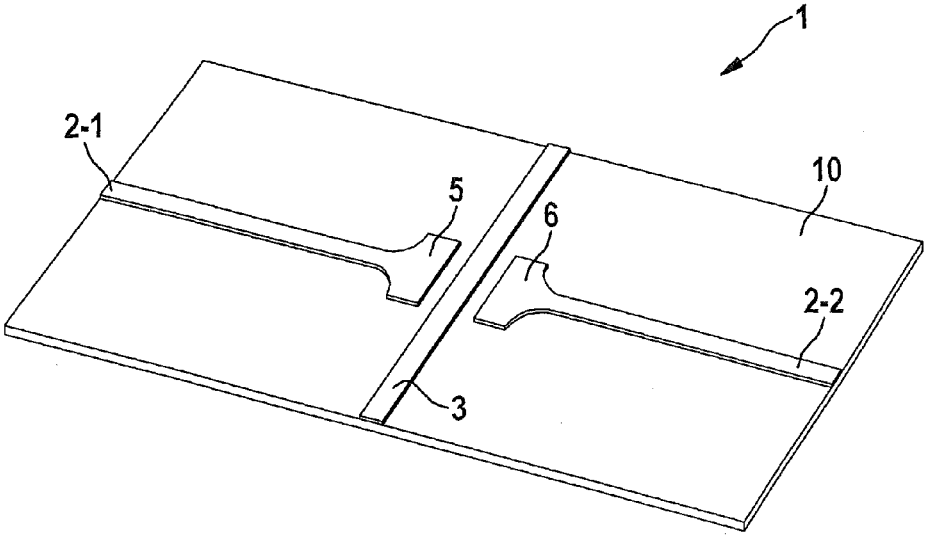
FIG. 3 shows another representation of one specific embodiment of a line bridging element according to the present invention.

One possible embodiment of the interruption of first microstrip line 2-1, 2-2 is exemplified in greater detail in FIG. 3.

Dielectric resonator 4 in FIG. 1 is configured as rectangular dielectric resonator 4. In other specific embodiments, other shapes for dielectric resonator 4 are possible. For example, dielectric resonator 4 may also be cylindrically or cubically configured.

The dimensions of the dielectric resonator are based on the electric resonator mode used and the permittivity of the material used for the dielectric resonator, and are calculated as a function of the frequency of the signal to be transmitted.

For example, dielectric resonator 4 in FIG. 1 may be configured to transmit a signal having a frequency of 77 GHz. In addition, the material of dielectric resonator 4 may have a relative permittivity of 3. In such case, the resonator may have a height of 1 mm, a width of 2 mm and a length of 3 mm.

If a high-frequency signal, for example, having a frequency of 77 GHz, is transmitted on first section 2-1 of first microstrip line 2-1, 2-2, the signal is coupled into dielectric resonator 4 by coupling point 5 at one end of dielectric resonator 4 and decoupled by second coupling point 6 from dielectric resonator 4 in second section 2-2 of first microstrip line 2-1, 2-2, and further transmitted on second section 2-2. It is possible, therefore, that on the same layer or the same coating of printed circuit board 10, the signal on first microstrip line 2-1, 2-2 crosses the second signal, which is transported on second microstrip line 3.

In one embodiment, dielectric resonator 4 has an edge length, which corresponds approximately to the wavelength of the signal to be transmitted.

Another possible way of calculating the volume or the dimensions of dielectric resonator 4 is the following:

The dimensions for a rectangular resonator 4 may be calculated on the basis of the following formula:

$$f = \frac{c0}{2\pi\sqrt{\varepsilon r}}\sqrt{kx^2 + ky^2 + kz^2}$$

kx, ky and kz are the wave numbers in the x, y and z direction and depend on the selected mode and the expansion in the respective direction. c0 is the free space light speed, epsilon_r is the relative permittivity of the material and f is the resonance frequency.

The dimensions may also be determined or optimized using numerical methods.

For a cylindrical/elliptical resonator 4, there are also analytical approaches, which have significantly more complex forms, however. An arbitrarily formed resonator must be configured numerically.

Dielectric resonator 4 in FIG. 1 is formed of a plastic. Possible materials for dielectric resonator 4 include in principle low-loss dielectrics with low relative permittivity. Teflon and LCP (liquid crystal polymer) would be possible, for example.

Other materials are also possible, if these have the physical properties necessary for transmitting the respective signal with the aid of dielectric resonator 4.

Figure 2:
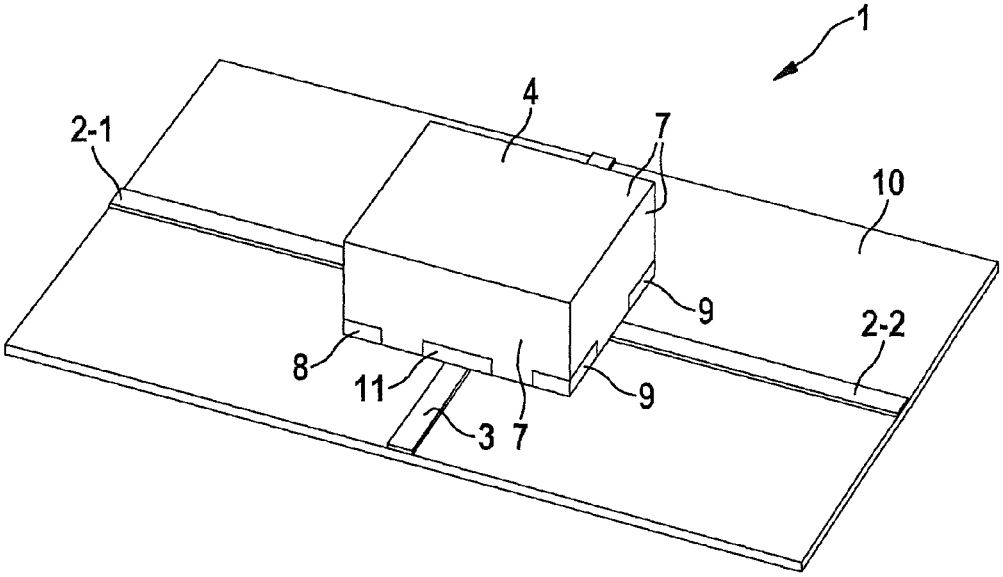
FIG. 2 shows another representation of one specific embodiment of a line bridging element according to the present invention.

FIG. 2 shows another representation of a specific embodiment of a line bridging element 1 according to the present invention.

Line bridging element 1 of FIG. 2 is largely identical to line bridging element 1 of FIG. 1, and differs from the latter in that the side surfaces and upper side of dielectric resonator 4 have a coating made of metal 7. Furthermore, dielectric resonator 4 has a solder pad 8, 9 at each end. In addition, the underside of dielectric resonator 4 includes an insulation 11 above second microstrip line 3, which serves to electrically insulate dielectric resonator 4 from second microstrip line 3.

In this case, insulation 11 may be configured as an insulating material. In another specific embodiment, insulation 11 may also be configured as a recess in dielectric resonator 4.

The solder pads are represented in FIG. 2 as solder pads 8, 9, each of which are situated at the lower corners of the dielectric resonator so that neither first microstrip line 2-1, 2-2 nor second microstrip line 3 is electrically contacted by any of solder pads 8, 9.

In one specific embodiment, solder pads 8, 9 are electrically coupled to the coating made of metal 7. In particular, solder pads 8, 9 may also be configured as part of the coating made of metal 7.

Solder pads 8, 9 may also be coupled on printed circuit board 10, for example, with a high-frequency ground.

The attachment of solder pads 8, 9 to the lower corners of dielectric resonator 4 is merely exemplary. In other specific embodiments, the solder pads 8, 9 may be attached at other points of the dielectric resonator.

FIG. 3 shows another representation of one specific embodiment of line bridging element 1 according to the present invention.

In FIG. 3, printed circuit board 10 is shown with two microstrip lines 2-1, 2-2 and 3 of FIG. 1. Unlike the line bridging element of FIG. 1, however, dielectric resonator 4 is not shown in FIG. 3. FIG. 3 serves, in particular, to illustrate first coupling point 5 and second coupling point 6. FIG. 3 clearly shows that the first microstrip line is interrupted under dielectric resonator 4 at a width which allows second microstrip line 3 to pass through this interruption. The ends of first microstrip line 2-1, 2-2 widen into the shape of a funnel toward the interruption, until they have reached the width of the dielectric resonator, with which they extend up to a predefined distance from second microstrip line 3. The distance to second microstrip line 3 is selected here in such a way that a cross-talk between first microstrip line 2-1, 2-2 and second microstrip line 3 is prevented or remains below a predefined threshold.

In FIG. 3, the ends of first microstrip line 2-1, 2-2 widen arcuately toward coupling points 5 and 6. In other specific embodiments, other widened shapes, for example, linear, are also possible.

Figure 4:
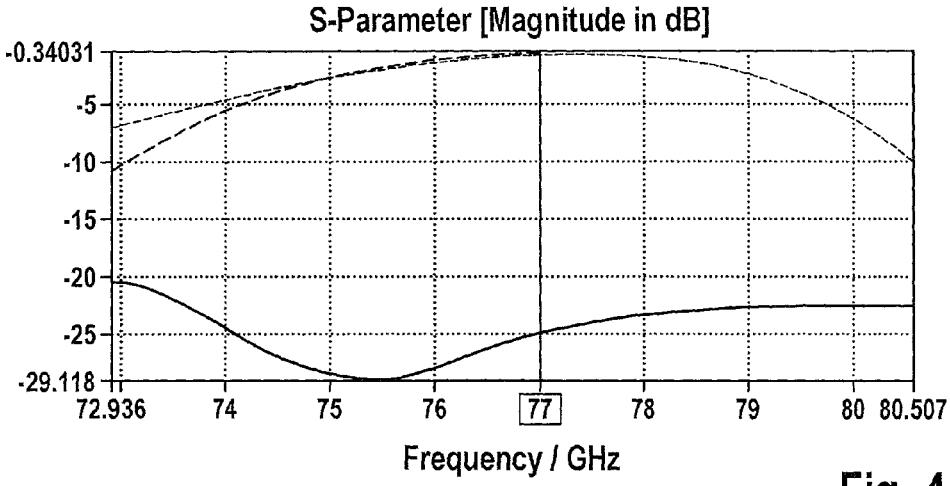
FIG. 4 shows a diagram which represents the signal attenuation on or the cross-talk between the two microstrip lines of one specific embodiment of a line bridging element according to the present invention.

FIG. 4 shows a diagram, which represents the signal attenuation on or the cross-talk between two microstrip lines 2-1, 2-2, and 3 of one specific embodiment of line bridging element 1 according to the present invention.

Three curves are plotted in FIG. 4. Plotted on the x-axis of the diagram is the frequency in GHz of 72.936 GHz to 80.507 GHz. The y-axis indicates the magnitude of the scattering parameter in dB and extends from 0.3403 dB to −29.118 dB.

The dotted plotted curve indicates the scattering parameter between the ends of first microstrip line 2-1, 2-2. The dashed plotted curve indicates the scattering parameter between the ends of second microstrip line 3 and the solid curve shown indicates the mutual coupling between two microstrips 2-1, 2-2 and 3.

The dotted plotted curve starts at 72.936 GHz at approximately −7 dB and extends arcuately to 77 GHz to the lowest attenuation of −0.482 dB and extends as a continuation of the arch up to 80.507 GHZ to an attenuation of −10 dB.

The dash-lined curve starts at 72.936 GHz at approximately −10.5 dB and extends arcuately to 77 GHz, from where it extends with the nearly constant attenuation up to 80.507 GHz.

The curve for the mutual coupling between two microstrip lines 2-1, 2-2 and 3 starts at 72.936 GHz at approximately −20.5 dB and extends to approximately 75.5 GHz to its minimum of −29.118 dB, where it then rises again to 80.507 GHz up to approximately −22.5 dB.

In FIG. 4, it is apparent that the signals on first microstrip line 2-1, 2-2 and second microstrip line 3 are carried with only a very slight attenuation of less than 0.5 dB on two microstrip lines 2-1, 2-2 and 3. It is also apparent that an undesirable cross-talk between two microstrip lines 2-1, 2-2 and 3 occurs to only a very limited extent, at a value of approximately −25 dB. This value ensures a sufficiently minimal cross-talk for transmitting high-frequency signals.

Figure 5:
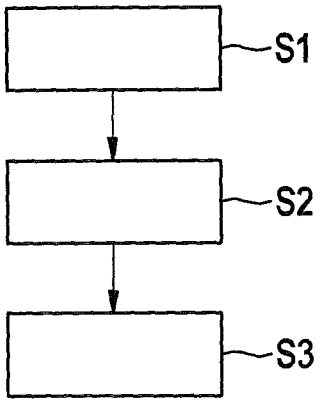
FIG. 5 shows a flow chart of one specific embodiment of the method according to the present invention.

FIG. 5 shows a flow chart of one specific embodiment of the method according to the present invention.

In a first step S1, the method provides for the arrangement of one first coupling point 5 in first microstrip line 2-1, 2-2, which couples a line-conducted electromagnetic wave carried in first microstrip line 2-1, 2-2 into dielectric resonator 4.

In a second step S2, a second coupling point 6 is arranged in first microstrip line 2-1, 2-2 opposite first coupling point 5, second coupling point 6 decoupling the electromagnetic wave, which was coupled in dielectric resonator 4, out of dielectric resonator 4 into first microstrip line 2-1, 2-2.

Finally, a third step S3 provides for the arrangement of dielectric resonator 4 on top of first coupling point 5 and second coupling point 6.

Figure 6:
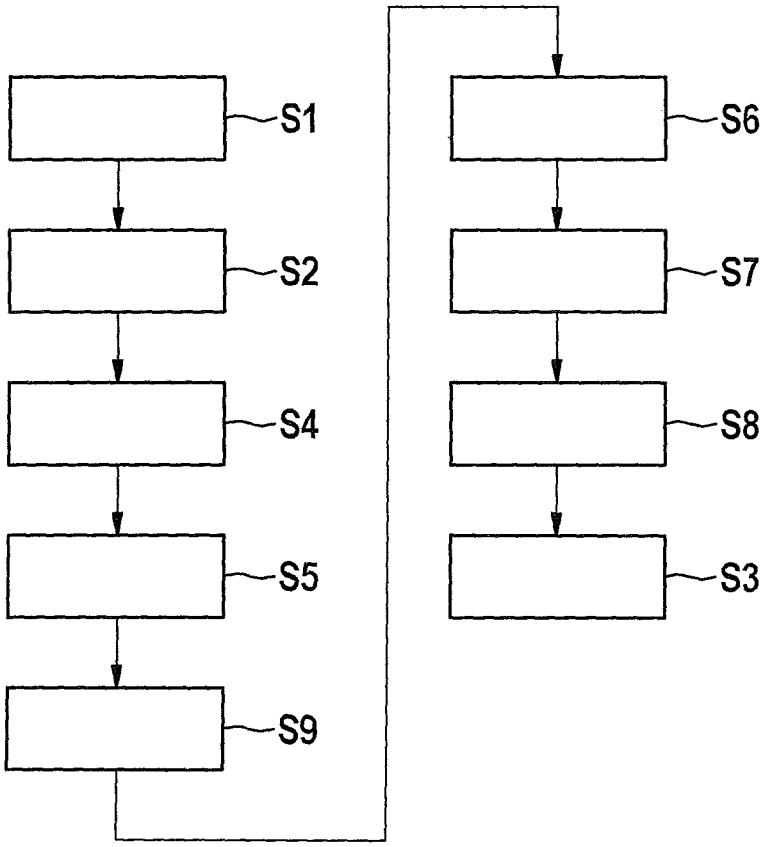
FIG. 6 shows a flow chart of another specific embodiment of the method according to the present invention.

FIG. 6 shows a flow chart of another specific embodiment of the method according to the present invention.

The method of FIG. 6 is based on the method of FIG. 5 and includes the additional steps S4 through S9. Steps S4, S5, S9, S6, S7 and S8 in this case fall between steps S2 and S3. The sequence of steps S1 through S9 indicated here is understood as merely suggestive. A different sequence of steps is also possible.

In step S4, first microstrip line 2-1, 2-2 is interrupted between the coupling points. In this case, the interruption may be the product of an etching process or of mechanical machining. The interruption may, however, also result from not applying conductive material to printed circuit board 10.

Fifth step S5 provides for the arrangement of second microstrip line 3 under dielectric resonator 4 between two coupling points 5 and 6.

Sixth step S6 provides for the forming of dielectric resonator 4 from a plastic having a rectangular shape, a cubed shaped or a cylindrical shape or the like.

In seventh step S7, dielectric resonator 4 is at least partially coated with metal 7.

In step S8, solder pads 8, 9 are attached to dielectric resonator 4, dielectric resonator 4 being affixed on printed circuit board 10 during arrangement S3 by soldering solder pads 8, 9 on printed circuit board 10.

In ninth step S9, first coupling point 5 and/or second coupling point 6 is/are formed from the width of first microstrip line 2-1, 2-2 to a predefined width in the direction of resonator 4, the predefined width corresponding in particular to the width of dielectric resonator 4.

Although the present invention has been described above with reference to exemplary embodiments, it is not limited thereto, but may be modified in a variety of ways. In particular, the present invention may be altered or modified in a multitude of ways without deviating from the essence of the present invention.

What is claimed is:

1. A line bridging element for two microstrip lines, each of which is configured for conducting electromagnetic waves having a wavelength in the millimeter wavelength range, comprising:

a dielectric resonator;

one first coupling point to couple one first line-conducted electromagnetic wave, which is carried in the first microstrip line, into the dielectric resonator; and one second coupling point to decouple the first electromagnetic wave coupled into the dielectric resonator from the dielectric resonator into the first microstrip line;

wherein the first microstrip line is interrupted between the first and the second coupling points, and wherein the second microstrip line runs under the dielectric resonator, between the first and the second coupling points and across an entire width of a printed circuit board on which the first microstrip line, the second microstrip line, the first coupling point, and the second coupling points are arranged.

2. The line bridging element of claim 1, wherein at least one of the first coupling point and the second coupling point widen(s) from the width of the first microstrip line to a predefined width in the direction of the resonator, to the width of the dielectric resonator.

3. The line bridging element of claim 1, wherein the dielectric resonator is formed from a plastic.

4. The line bridging element of claim 1, wherein the dielectric resonator is coated at least partially with metal.

5. The line bridging element of claim 1, wherein the dielectric resonator includes solder pads which are solderable onto the printed circuit board and are configured to fix the dielectric resonator on the printed circuit board.

6. The line bridging element of claim 5, wherein the solder pads are electrically coupled to the metal.

7. The line bridging element of claim 1, wherein the dielectric resonator has one of a rectangular parallelepiped shape, a cubed shape, and a cylindrical shape.

8. The line bridging element of claim 1, wherein at least one of the first coupling point and the second coupling point widen(s) from the width of the first microstrip line to a predefined width in the direction of the resonator.

9. A method for manufacturing a line bridging element for two microstrip lines, each of which are configured for conducting electromagnetic waves having a wavelength in the millimeter wavelength range, the method comprising:

arranging one first coupling point in the first microstrip line, which couples a first line-conducted electromagnetic wave carried in the first microstrip line, into a dielectric resonator;

arranging one second coupling point opposite the first coupling point, the second coupling point decoupling the electromagnetic wave coupled into the dielectric resonator from the dielectric resonator into the first microstrip line; and arranging the dielectric resonator on top of the first coupling point and the second coupling point;

wherein the line bridging element includes:

the dielectric resonator;

the first coupling point to couple one first line-conducted electromagnetic wave, which is carried in the first microstrip line, into the dielectric resonator; and the second coupling point to decouple the first electromagnetic wave coupled into the dielectric resonator from the dielectric resonator into the first microstrip line;

interrupting the first microstrip line between the first and the second coupling points; and arranging the second microstrip line such that the second microstrip line runs under the dielectric resonator, between the first and the second coupling points and across an entire width of a printed circuit board on which the first microstrip line, the second microstrip line, the first coupling point, and the second coupling points are arranged.

10. The method of claim 9, further comprising:

at least one of:

forming the dielectric resonator from a plastic having a rectangular parallelepiped shape, a cubed shaped or a cylindrical shape; and coating the dielectric resonator at least partially with metal.

11. The method of claim 9, further comprising:

arranging solder pads on the dielectric resonator, the dielectric resonator being fastened during arranging on the printed circuit board, by soldering the solder pads on the printed circuit board.

12. The method of claim 9, further comprising:

forming at least one of the first coupling point and the second coupling point from the width of the first microstrip line up to a predefined width in the direction of the resonator, the predefined width corresponding to the width of the dielectric resonator.

* * * * *